United States Patent [19]

Ball

[11] Patent Number: 4,687,040

[45] Date of Patent: Aug. 18, 1987

[54] ADJUSTING DEVICE FOR A SLAT BLIND

[76] Inventor: James Ball, 14236 Greencrest Drive, White Rock, British Columbia, Canada, V4A 2Y6

[21] Appl. No.: 840,643

[22] Filed: Mar. 17, 1986

[51] Int. Cl.[4] ..... E06B 3/32

[52] U.S. Cl. ..... 160/107; 160/176 R

[58] Field of Search ..... 160/107, 176 R, 168 R; 49/64

[56] References Cited

U.S. PATENT DOCUMENTS

| | | | |
|---|---|---|---|
| 3,443,624 | 5/1969 | Toth | 160/176 X |
| 3,703,920 | 11/1972 | Debs | 160/107 |
| 3,719,221 | 3/1973 | Hanson | 160/107 X |
| 4,122,884 | 10/1978 | Salzmann | 160/176 R X |
| 4,274,469 | 6/1981 | Kuyper | 160/107 |
| 4,369,828 | 1/1983 | Tatro | 160/107 |
| 4,459,778 | 7/1984 | Ball | 160/107 X |

FOREIGN PATENT DOCUMENTS

| | | | |
|---|---|---|---|
| 756848 | 4/1967 | Canada | 160/107 |
| 1113641 | 5/1968 | United Kingdom | 160/107 |

*Primary Examiner*—Ramon S. Britts
*Assistant Examiner*—David M. Purol
*Attorney, Agent, or Firm*—Ridout & Maybee

[57] ABSTRACT

A mechanism for adjusting the tilt angle of slats of a slat blind positioned between the panes of glass of a sealed window unit is described. The mechanism is sealed about an aperture through one of the panes and includes a flexible cable within a flexible tube extending from the mechanism to the control mechanism for the blind. The flexible tube maintains the window seal and the cable enables torque to be transmitted from the mechanism to the tilt control mechanism of the blind, thereby allowing direct external mechanical control of the tilt angle of the slats without breaking the hermetic seal for the window.

11 Claims, 2 Drawing Figures

ADJUSTING DEVICE FOR A SLAT BLIND

The present invention relates to a sealed double glazed window having a slat blind positioned between the panes of glass, and having a device sealingly mounted on one of the panes for allowing adjustment of the tilt angle of the slats while maintaining the window seal.

Prior efforts to provide a device for adjusting a slat blind within a sealed window have resulted in devices which leak, thereby causing condensation and dirt to enter between the panes of glass, or have produced sealed units which may be operated magnetically. An example of the first type of mechanism is described in U.S. Pat. No. 2,490,295 issue Dec. 6, 1949 to E. G. Fisher. The magnetically activated device is exemplified in U.S. Pat. No. 3,201,832 issued Aug. 24, 1965 to V. A. Hordis et al.

A device which is superior to both of the foregoing types is described in the present applicant's U.S. Pat. No. 4,459,778 issued July 17, 1984. The device described in this latter patent provides direct mechanical interaction with the control mechanism of the slat blind while maintaining a reliable seal for the window. This is accomplished by providing a flexible diaphragm sealed about an aperture through a pane of the window and having adjusting means passing through the aperture from the diaphragm to the control mechanism of the blind.

The present invention also provides a direct mechanical connection from the slat tilt angle control means through an aperture in a pane of the window so that the tilt angle of the slats can be adjusted without breaking the window seal. The invention provides in a preferred embodiment an adjusting device which maintains a secure seal about an aperture through a pane of the window and which is elegantly simple in design so that assembly, maintenance and repair of the adjusting device and total window assembly is facilitated.

Accordingly, the invention provides a sealed double glazed window comprising, two spaced panes of glass sealed in a frame, and a slat blind positioned in the space between the panes. The blind is provided with means for controlling the tilt angle of the slats. The inside pane of glass has an aperture therethrough to provide access to the control means of the blind, and an adjusting device is mounted about the aperture so that the slats may be adjusted while maintaining the window seal. The adjusting device comprises a plug which is sealed about the aperture through the glass pane, the plug defining a tubular portion being open at both ends thereof. A flexible tube is sealed about the tubular portion and extends therefrom into a sealing engagement with the slat blind control means. A flexible cable is attached at one end to the control means and the other end extends through the flexible tube and tubular portion of the plug so that it may be manipulated to adjust the tilt angle of the slats.

BRIEF DESCRIPTION OF THE DRAWINGS

As seen in FIG. 1, a window 10 in accordance with a preferred embodiment of the invention comprises inner and outer panes 13 and 14 spaced from one another and sealed in a frame 15. A slat blind 17 is positioned in the space defined between the two panes of glass 13 and 14 and is preferably secured to the frame 15 at both the top and bottom thereof.

Figure 1:
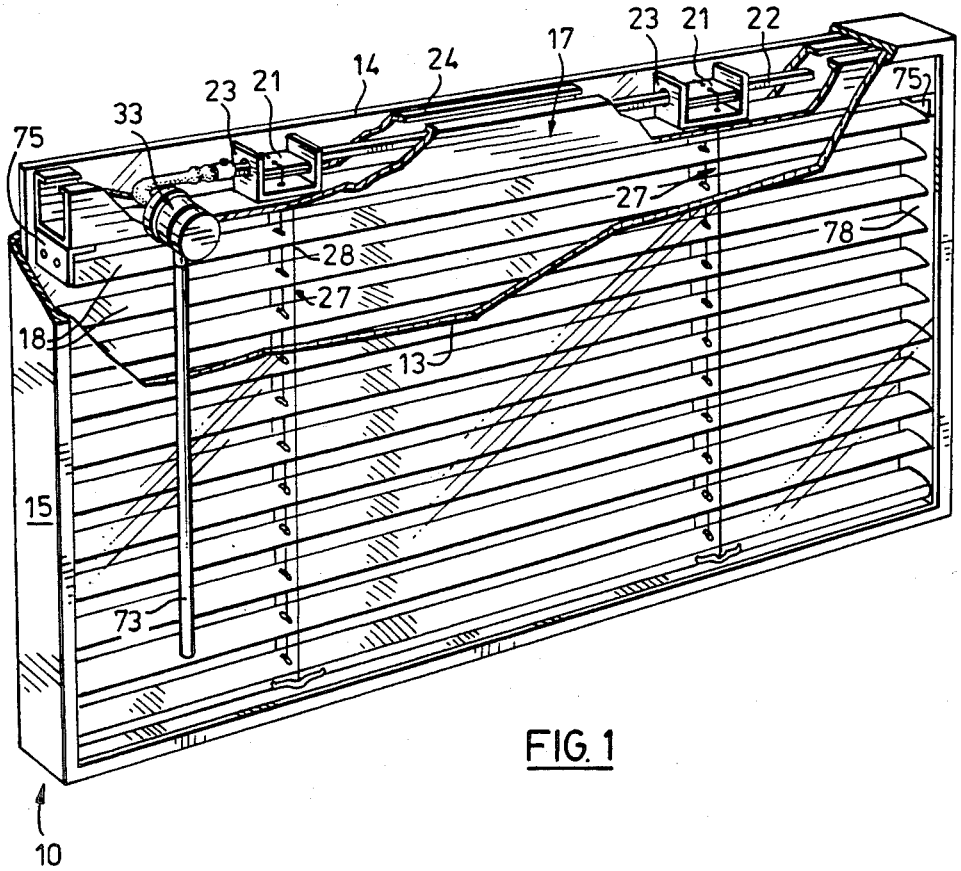
FIG. 1 is a front perspective view of a window having the adjusting means of the invention.

The blind 17 has means for controlling the tilt angle of the slats 18 which may conveniently be located at the top of the blind 17. The control means preferably comprises rectangular members 21 mounted on a control rod 22 which in turn is held in brackets 23 mounted in a head channel structure 24 for the blind. The slats 18 of the blind 17 are supported in spaced relationship to one another by ladders 27 having outer vertical members 28 extending from the bottom slat 18 to the control means. Each upper end of the vertical ladder members 28 is partially wrapped about and affixed to the rectangular members 21 so that rotation of the members 21 effects a change in the tilt angle of the slats 18. The control rod 22 mounted through both rectangular members 21 enables a coordinated rotation of both rectangular members 21 by rotation of the rod 22.

It will be apparent to the person skilled in this art that alternative control means for the slat blind may be used within the scope of the present invention.

An aperture 31 is defined through the inner pane of glass 13 to provide access to the slat tilt angle control means of the blind 17. In the illustrated embodiment, the aperture 31 is made through the pane 13 near the upper edge thereof toward one side.

An adjusting device 33 is sealingly mounted about the aperture 31. The device 33 comprises a plug 35 sealed about the aperture 31. The seal may be effected by providing the plug 35 with an annular flange 36 for engaging the inner side of the pane 13 and by providing the outer surface of the plug 35 with a thread 37 upon which a nut 39 can be screwed to sealingly secure the flange 36 of the plug 35 about the aperture 31. The seal about the plug 35 may be further assisted by providing a sealant 41 between the opposing flange 36 and glass 13 surfaces as well as between the opposing nut 39 and glass 13 surfaces.

The plug 35 comprises structure defining a tubular portion 43 which is open at both ends thereby effectively reducing the size of the aperture 31 to the diameter of the tubular portion 43. The seal about the tubular portion 43 is maintained by a flexible tube 45 extending from the tubular portion 43 to the control means for the blind 17. Thus, an end of the flexible tube 45 is fitted about the tubular portion 43 and sealed by means of a crimping ring 46 or a sealant adhesive (not shown). The seal is maintained about the other end of the flexible tube 45 in the same fashion, the other end of the tube 45 preferably being fitted about an adaptor 48 attached to the end of the control rod 22.

Rotation of the control rod 22 is achieved by means of a flexible cable 51 which extends through the tubular portion 43 of the plug 35 and the flexible tube 45 into engagement with the adaptor 48 which has means for receiving an end of the cable 51. This receiving means of the adaptor 48 is preferably a squared hole 53 defined by opposing arms 54 of the adaptor 48 into which a squared end 55 of the cable 51 is insertable. The opposite end of the cable 51 is also squared and extends beyond the front of the plug 35 so that the cable 51 may be manipulated to rotate the control rod 22, and hence, adjust the tilt angle of the slats 18 of the blind 17.

Figure 2:
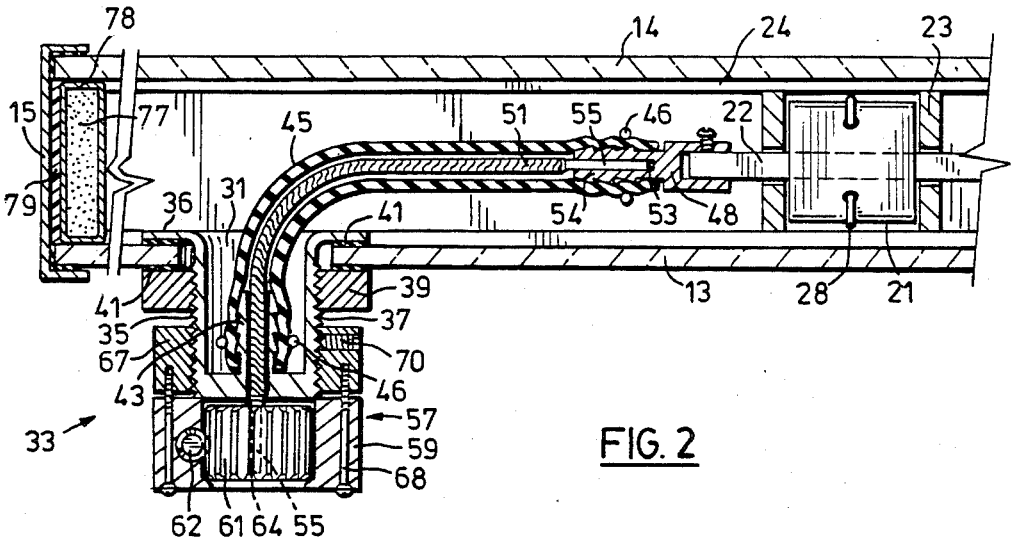
FIG. 2 is a sectional detail showing the adjusting means as installed.

Conveniently, the squared end 55 of the cable 51 extending from the front of the plug 35 may be manipulated by means of a worm and gear mechanism 57. As shown in FIG. 2, the mechanism 57 preferably comprises a housing 59 within which are positioned a worm gear 61 and a worm 62 coacting with the gear 61 so that rotation of the worm 62 causes rotation of the worm gear 61. The worm gear 61 defines an aperture 64 centrally therethrough for receiving the squared end 55 of the cable 51. Thus, rotation of the worm gear 61 causes rotation of the cable 51 and the control rod 22 thereby providing tilt adjustment control for the slats 18 of the blind 17.

The mechanism 57 may be attached to the front of the plug 35 as shown in FIG. 2 by providing a second nut 67 about the threaded plug 35 having means for receiving fasteners 68 extending from the mechanism 57 to attach the mechanism 57 to the nut 67. The nut 67 may be secured in place on the plug 35 by means of an allen screw 70 extending radially through the nut 67 to engage the outer surface of the plug 35. Suitable fasteners 68 may be screws which pass through the housing 59 into suitable holes provided in the nut 67 for receiving the ends of the screws 68.

As shown in FIG. 1, the worm 62 preferably has means for attaching a rod 73 thereto for rotating the worm 62. As will also be apparent to the skilled person, the gear ratios of the worm 62 and gear 61 may be varied to give a rapid or gradual control of the tilt angle for the slats 18.

The flexible cable 51 is preferably of metal and must be capable of transmitting torque from one end to the other when bent at an angle of about 90°. A suitable cable 51 is presently used widely in the automotive field in association with speedometers.

Associated with the slat blind 17 and adjusting mechanism 33 of the invention are means for supporting the head channel structure 24 in the frame 15 and dessicant means within the sealed window to remove undesirable humidity from the air within the sealed window. The support means may comprise brackets 75 beneath the channel structure 24 at either end thereof. Dessicant 77 may be inserted in spacers 78 located at either end of the head channel structure 24 and running along the length of the upright frame members 15. The spacers 78 may be held and sealed in place against the frame 15 by means of an adhesive sealant 79. The support brackets 75 may be mechanically attached to the spacers 78.

The foregoing has been a description of a preferred embodiment of the invention, and modifications and variations may be made thereto within the scope of the invention as defined in the following claims.

I claim:

1. A sealed double glazed window, comprising:

two spaced panes of glass sealed in a frame;

a slat blind positioned in the space between the panes, the blind having slat tilt angle control means associated therewith;

an aperture defined through one pane of glass providing access to the slat tilt angle control means of the blind;

an adjusting device sealingly mounted about the aperture so that the tilt angle of the slats may be adjusted while maintaining thw window seal, the device comprising a plug including a threaded outer cylindrical surface extending outwardly through the aperture and having an annular flange portion engaging a surface of the pane of glass, the flange being sealed about the aperture, the plug defining a tubular portion being open at both ends thereof and extending inwardly from a planar front surface of said pulg, a flexible tube sealed about the tubular portion and extending therefrom into a sealing engagement with the slat tilt angle control means of the blind, a flexible cable being attached at one end to the tilt angle control means, said cable extending through the flexible tube and tubular portion so that the other end thereof may be manipulated to adjust the tilt angle of the slats, and a nut coacting with the threaded outer surface of the plug to provide a sealing engagement of the plug about the aperture.

2. A window as claimed in claim 1, further comprising a sealant material provided between the flange portion of the plug and the glass surface.

3. A window as claimed in claim 2, further comprising a sealant material provided between the nut and the glass surface.

4. A window as claimed in claim 1, wherein the flexible cable is metal.

5. A window as claimed in claim 1, further comprising means associated with the end of the flexible cable extending through the tubular portion of the plug for manipulation of the cable.

6. A window as claimed in claim 5, wherein the means associated with said cable end comprises a worm and gear mechanism.

7. A window as claimed in claim 6, wherein the flexible cable is provided with squared end portions adapted to be attachable to the slat tilt angle control means and the worm and gear mechanism.

8. A window as claimed in claim 7, wherein the worm and gear mechanism comprises a housing within which are positioned a worm gear and a worm coacting with the gear so that rotation of the worm causes rotation of the worm gear, and the worm gear defining an aperture extending centrally therethrough for receiving a squared end of the flexible cable.

9. A window as claimed in claim 3, further comprising a worm and gear mechanism coacting with an end of the flexible cable to provide manipulation thereof, said mechanism being attached to the plug by means of fasteners extending from the mechanism to engagement with said nut.

10. A window as claimed in claim 8, wherein the plug has a threaded outer surface, a first nut coacting with the plug to provide a sealing engagement of the plug about the aperture, a second nut coacting with the plug and having means therein for receiving fasteners extending from the worm and gear mechanism thereby providing means for attaching the mechanism to the plug.

11. A window as claimed in claim 4, wherein the flexible metal cable is capable of transmitting torque from one end to the other when bent at an angle of about 90°.

* * * * *